US012403992B1

(12) United States Patent
Naiman et al.

(10) Patent No.: US 12,403,992 B1
(45) Date of Patent: Sep. 2, 2025

(54) METHOD FOR MAINTAINING THE OUTER SURFACE OF A HULL UTILIZING AN IN-LINE MULTI-NODE TETHER MANAGEMENT ARRANGEMENT

(71) Applicant: United States of America as Represented by the Secretary of the Navy, Arlington, VA (US)

(72) Inventors: Matthew Naiman, Middleborough, MA (US); William M Hertel, III, Annapolis, MD (US)

(73) Assignee: The United States of Ameria, as represented by the Secretary of the Navy, Washington, DC (US)

( * ) Notice: Subject to any disclaimer, the term of this patent is extended or adjusted under 35 U.S.C. 154(b) by 415 days.

(21) Appl. No.: 17/949,399

(22) Filed: Sep. 21, 2022

Related U.S. Application Data

(60) Provisional application No. 63/405,680, filed on Sep. 12, 2022.

(51) Int. Cl.
*B63B 59/08* (2006.01)
*B63B 59/10* (2006.01)
*B63G 8/00* (2006.01)

(52) U.S. Cl.
CPC ..... *B63B 59/08* (2013.01); *B63B 59/10* (2013.01); *B63G 8/001* (2013.01)

(58) Field of Classification Search
CPC ..... B63B 59/00; B63B 59/08; B63B 59/10; B63B 81/00; B63G 8/00; B63G 8/001
USPC ..... 114/312, 322
See application file for complete search history.

(56) References Cited

U.S. PATENT DOCUMENTS

| | | | | |
|---|---|---|---|---|
| 4,010,619 | A * | 3/1977 | Hightower | B63C 11/48 114/322 |
| 4,502,407 | A * | 3/1985 | Stevens | B63G 8/001 114/222 |
| 6,390,012 | B1 * | 5/2002 | Watt | B63G 8/001 114/322 |
| 8,506,719 | B2 | 8/2013 | Holappa | |
| 9,080,425 | B2 * | 7/2015 | Zediker | B63G 8/001 |
| 9,180,934 | B2 | 11/2015 | Smith | |
| 9,434,456 | B2 | 9/2016 | Højer | |
| 9,440,717 | B2 | 9/2016 | Rooney, III | |
| 9,540,076 | B1 * | 1/2017 | Trail | B63B 27/08 |
| 9,840,313 | B2 | 12/2017 | Cioanta | |
| 10,167,650 | B2 | 1/2019 | Torem | |
| 10,272,980 | B2 | 4/2019 | Abdellatif | |
| 11,008,078 | B2 | 5/2021 | Bardelli | |
| 2010/0139541 | A1 | 6/2010 | Porthouse | |
| 2022/0266963 | A1 | 8/2022 | Klaptocz | |

* cited by examiner

*Primary Examiner* — Lars A Olson
(74) *Attorney, Agent, or Firm* — Dave Ghatt; Jesus J. Hernandez

(57) ABSTRACT

A method of maintaining an outer surface of a hull, including providing a power source and an end effector vehicle for performing maintenance operations on the hull, the method of maintaining including providing an in-series tether management system having one or more nodes, and umbilical line sections extending through the one or more nodes to the end effector vehicle, transmitting power from the power supply to the end effector vehicle, and including selecting a work area, and positioning the one or more nodes and end effector to perform maintenance in the defined work area.

3 Claims, 11 Drawing Sheets

METHOD FOR MAINTAINING THE OUTER SURFACE OF A HULL UTILIZING AN IN-LINE MULTI-NODE TETHER MANAGEMENT ARRANGEMENT

CROSS-REFERENCE TO RELATED APPLICATIONS

This application claims the benefit of U.S. Provisional Application No. 63,405,680 filed Sep. 12, 2022, titled "Multi-Node Tether Management System for Underwater Robots," incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a hull maintenance system, and more particularly, a hull maintenance system with an autonomous or semi-autonomous maintenance end effector vehicle, including a multi-node tether management system having a umbilical line sections extending through one or more nodes to the autonomous or semi-autonomous end effector vehicle, for powering, communicating, and navigating, and ensuring precise vehicle operations.

BACKGROUND

Waterborne underwater hull maintenance is critical to the worldwide operation of Navy ships and impacts operating capability (e.g., speed and maneuverability), fuel efficiency and the maintainability and lifecycle of critical systems including underwater hull coatings and propulsion systems. This maintenance, which includes the grooming/cleaning and surveying of hull surfaces may be accomplished by utilizing on-hull remotely operated autonomous or semi-autonomous underwater vehicles, which for power-delivery optimization may require umbilical lines for these operations. The umbilical lines may also serve as tethers on the vehicles.

During maintenance operations, the umbilical/tethers require band management from a pier, a deck, or a small boat alongside vessels being serviced. Divers are traditionally employed for most underwater ship husbandry operations, including controlling and managing coverage efficacy. Similarly, crawling vehicles developed for underwater use, particularly for application on underwater ship hulls, must be manually driven to achieve coverage or must rely on externally applied integrated navigation systems that do not provide sufficient capability for continuous, mostly unattended operation. It is desired to have improved tether management for autonomous and semi-autonomous operations of vehicles that provides a capable and improved means for navigating, positioning, and the tracking of the vehicle, as well as improved power throughput and tangle-free performance.

SUMMARY

In one aspect, the invention is a method of maintaining the outer surface of a hull. In this aspect, the method includes, providing a power source, and on the outer surface of the hull, providing one or more node vehicles each node having a node sensor suite. The method also includes providing an end effector vehicle to perform maintenance routines, the end effector having hull maintenance tools and a sensor suite, as well as providing a plurality of umbilical line sections for providing power to the one or more node vehicles and the end effector vehicle. In this aspect, the umbilical sections extend in an in-line arrangement connecting the one or more node vehicles and the end effector vehicle to the power source. The method also includes the partitioning of the outer surface of the hull into different segments that define work areas, and selecting one of the defined work areas to begin hull maintenance. In this aspect, the method also includes positioning of the one or more node vehicles onto the hull surface within the selected defined work area, and positioning of the end effector vehicle onto the hull surface within the selected defined work area.

According to the invention, the method of maintaining the outer surface of a hull also includes initializing system sensor suites of the one or more node vehicles and the end effector, and initiating the end effector vehicle to perform a maintenance routine within the selected work area. In this aspect, the method also includes utilizing the sensor suites to track the location of the end effector vehicle to maintain a desired tether tension in the umbilical line sections to prevent entanglement of the umbilical line sections.

DETAILED DESCRIPTION

Figure 1A:
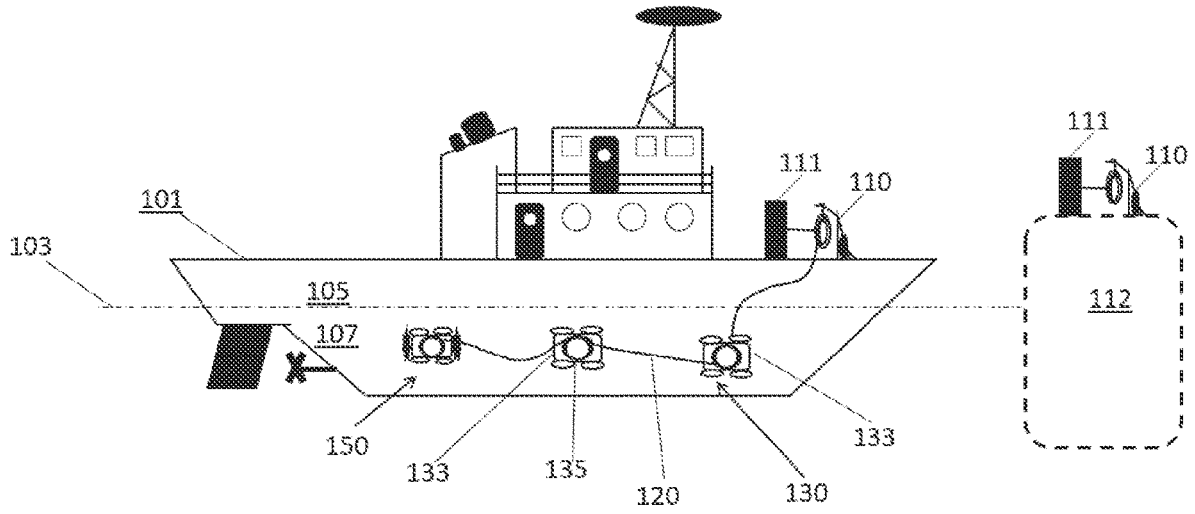
FIG. 1A is an exemplary side view of a hull maintenance system, having an end effector and an in-line tether management system having one or more nodes, according to an embodiment of the invention.

FIG. 1A is an exemplary side view illustration of a hull maintenance system, according to an embodiment of the invention. As shown the system includes a hull of a water vessel 101, which may be a ship or the like. The water vessel hull 101 is in a large body of water, and the water vessel may be in the open water or may be docked FIG. 1A shows the waterline 103, and the regions 105 of the hull 101 that are above the waterline and regions 107 below the waterline. One of the goals of the invention is to provide hull maintenance in this water-based environment. As outlined below, maintenance activities may include the grooming/cleaning and surveying of a hull surface for inconsistencies and/or objects, as well as the in-situ monitoring of these activities.

FIG. 1A also shows an umbilical line supply reel 110 and main power source 111 on the upper deck 102 of the hull 101 above the waterline 103. FIG. 1A also shows the supply reel 110 and main power source 111 alternatively located at 112, which may be a dock or a floating barge or the like. It should be understood that the supply reel 110 and power source 111 may be one integrated unit. The power source/supply 111 is for transmitting power throughout the system. The supply reel 110 may be any known tensioned reel device for supporting, paying-out, and retrieving cords, cables, ropes, hoses, lines and the like. The supply reel 110 may be manually controlled, automatically controlled, or a combination thereof, and may include reel sensors and tension sensors to detect pay-outs and the tautness or slackness in the umbilical line.

The supply reel 110 carries for payout and retrieval, an umbilical line section 120, which may be a cable or the like that includes power lines and may also include multiplex (or dedicated path for each) communication lines within. Each umbilical line section 120 is also made from a material such as an elastomer or synthetic material that is strong enough to physically withstand the forces created by the pulling and tugging of the different elements, including the node vehicles and the end effector vehicle 150. As outlined below, the umbilical sections 120 deliver power to the various nodes and the end effector 150. By delivering this power in this manner, there is no need for batteries and battery charging as required by non-tethered vehicle schemes, and enables the delivery of greater power and energy to the nodes and end effector vehicle 150. According to an embodiment of the invention, the umbilical line sections 120 may also deliver signals via communication lines within the sections.

As shown in FIG. 1A the hull maintenance system also includes a tether management system 130. The tether management system 130 is an in-line (in-series) system, as the umbilical sections 120 extend directly from the power source 111 and supply reel 110 to one or more nodes 133 and to the end effector 150. In the in-series arrangement, there are no umbilical line sections 120 that branch from another umbilical line section 120. The in-series arrangement does not include any roller or rollers, rolling along the umbilical sections. Additionally, as outlined below, each node 133 includes only two umbilical sections, a first attached at a fore end junction, and a second extending from the reel within the node, exiting either through an aft end of the node or through one of the two side portions of the node.

The in-line/in-series tether management system 130 may include one or more nodes 133 positioned on the outer surface region 107 below the waterline 103. As stated above, the umbilical line sections 120 which extends from the supply reel 110 and power source 111, may power each of the one or more node vehicles 133. An exemplary node vehicle, according to an embodiment of the invention, has a fore end and an aft end. A junction where the umbilical section is attached to relay the power from the power source. A node reel carries thereon an umbilical line section. When power is received at the junction as outlined above, the node may transmit this power via the umbilical line section stored on the node reel. To transmit this power to another node or to an end effector vehicle, the umbilical section may be deployed through the aft end or through the first or second sides. The structure of the node is applicable to all the nodes shown in FIGS. 1A to IF.

The nodes may be vehicles that may be operated manually by remote control for example, autonomously, or a combination thereof. The nodes may have wheels allowing them to crawl along the hull surface. A known steering mechanism may be attached to the wheels to direct the nodes in any desired position on the hull. The known steering mechanism may for example include a steering column upon which the wheels are turnably mounted, or ball joint and bearing arrangements for independently moving each wheel. Alternatively, the nodes may have tracks. The nodes may also include other known driving mechanisms for driving and steering the node about the hull surface. The nodes may employ negative pressure or magnetism as a means to maintain contact with the hull surface. According to an embodiment in which the nodes are not vehicles, the nodes may have rails, legs, or other known fastening devices for fixing the node to the hull surface at a desired location.

The node reel pays-out, reels-in the umbilical line section, and controls the tension in that line. For controlling tether tensions, each node reel may be equipped known devices such as tether fair-lead and slip ring arrangements. Each node reel also includes tension sensors for sensing tensions in the umbilical sections. The nodes also include a sensor suite. As outlined below, the sensor suite includes sensors that help to detect the location of the end effector vehicle. These features as outlined combine to determine the location of the end effector and to control tension and avoid slack in the umbilical, thereby preventing entanglement.

As shown in FIG. 1A, the end effector vehicle 150 is positioned and movable on the outer surface in region 107 below the waterline 103 to effect maintenance thereon. The end effector vehicle 150 may be a surface crawling vehicle, utilizing negative pressure. According to another embodiment of the invention, the end effector vehicle 150 may utilize magnetic forces to stay attached to the hull surface. The vehicle 150 may have wheels or tracks to crawl along the hull surface. The end effector vehicle 150 may be a cleaning/grooming vehicle that grooms via direct contact with the hull surface by using brushes and the like, or that provides contactless cleaning, via waterjets, UV rays, and the like, or vehicle that provides a combination of contact and contactless cleaning. The end effector vehicle 150 may also include surveying/inspecting capabilities, having for example, real time video recorders and related sensors that survey and collect information/data about the surface and which provide maintenance logistics, including data pertaining to surface coatings, fouling, or the detection of foreign objects. The video recording devices and other may also perform telemetry functions.

Figure 2A:
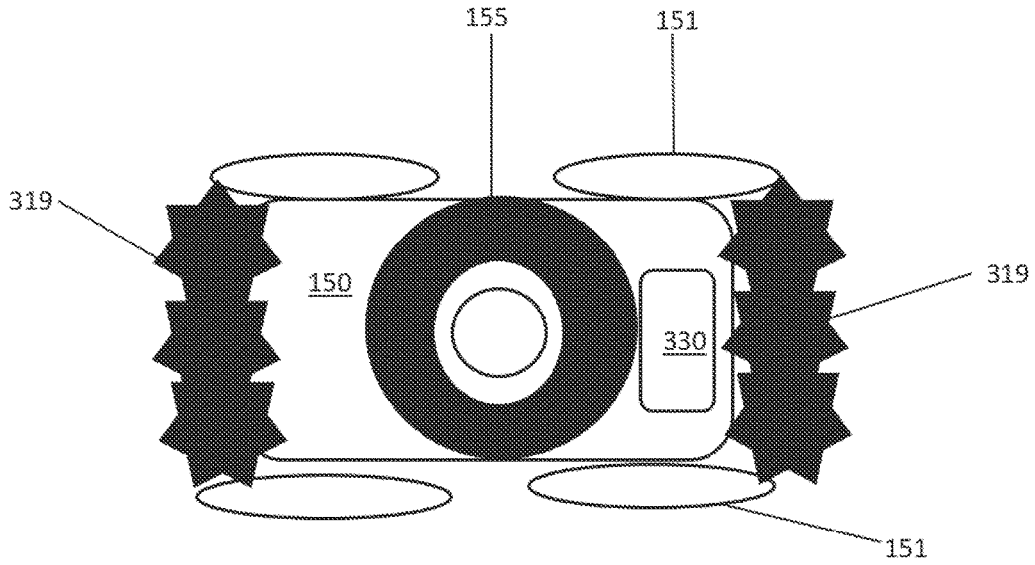
FIG. 2A is an exemplary schematic illustration of an end effector vehicle, according to an embodiment of the invention.

FIG. 2A is an exemplary schematic illustration of an end effector vehicle 150, according to an embodiment of the invention. As shown, the end effector vehicle 150 includes a reel 155 for paying-out, reeling-in, and controlling the tension in the umbilical line section 120 associated with the end effector 150. As shown in FIG. 1A, the umbilical section 120 may extend from the end effector reel 155 to the node reel of the adjacent node. For controlling tether tensions, each reel 155 may be equipped known devices such as tether fair-lead and slip ring arrangements. Each end effector reel 155 also includes a tension sensor arrangement for sensing tensions in the umbilical section 120 and for maintaining the desired tension in the system. As shown in FIG. 2A, the end effector vehicle 150 includes wheels 151 for crawling about the outer surface of the hull. Although not illustrated in this figure, a known steering mechanism may be attached to the wheels 151 to direct the end effector vehicle 150 in any desired position on the hull. The known steering mechanism may for example include a steering column upon which the wheels 151 are turnably mounted, or ball joint and bearing arrangements for independently moving each wheel, or the like. Alternatively tracks or other known driving devices may be employed for crawling about the hull surface.

The end effector vehicle 150 also includes hull maintenance tools, grooming/cleaning mechanisms 319 for grooming and maintaining the surface of the hull. The grooming/cleaning mechanisms 319 may include brushes, waterjets, UV rays, and the like, or combination thereof. The combination of grooming/cleaning mechanisms used may depend on known factors, such as for example, the degree and type of fouling, the type of coating on the hull surface, or the time available to perform servicing. The end effector vehicle also includes a sensor suite 330. As outlined below, the sensor suite 330 includes sensors, which in combination with sensors in the node sensor suite 320, detect the location of the end effector vehicle 150. These features as outlined combine to determine the location of the end effector 150 and is used to control tension and to avoid slack in the umbilical 120, thereby preventing entanglement.

Figure 2B:
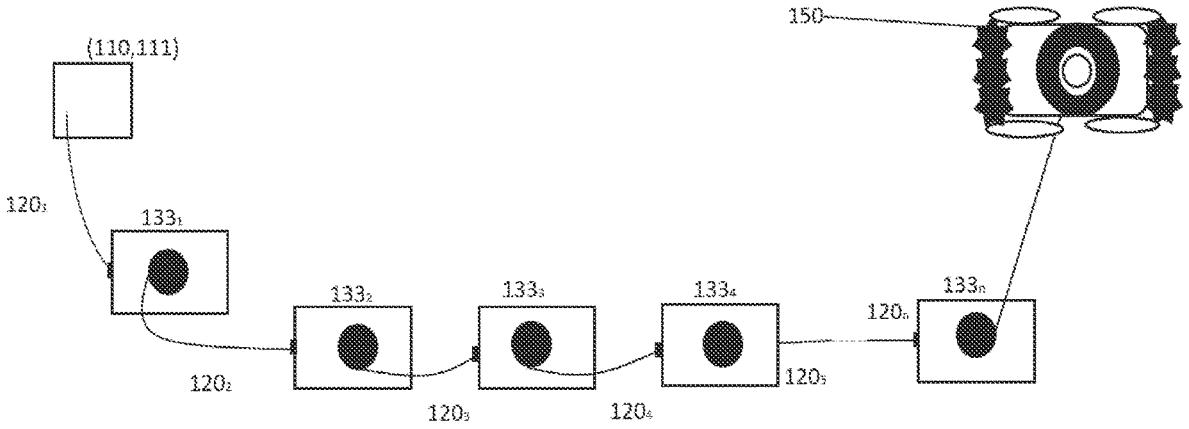
FIG. 2B is an exemplary schematic illustration of an in-series arrangement of the tether management system, according to an embodiment of the invention.

FIG. 2B is an exemplary schematic illustration of an in-series arrangement of the tether management system 130, according to an embodiment of the invention. FIG. 2B shows umbilical line sections $\mathbf{120}_1$-$\mathbf{120}_n$ extending from the power source 111, to a first node $\mathbf{133}_1$, and from the first node $\mathbf{133}_1$ to a second node $\mathbf{133}_2$, and from the second node $\mathbf{133}_2$ to a third node $\mathbf{133}_3$ and a fourth $\mathbf{133}_4$ to an $n^{th}$ node $\mathbf{133}_n$ (which represents any desired total number of nodes in the in-series arrangement) then to the end effector 150. These connections enable power to be transmitted from the power source 111 to the first node $\mathbf{133}_1$ through to the nth node $\mathbf{133}_n$ and to the end effector 150. The number of nodes n depends on the particular arrangement.

As shown in FIG. 2B, in the in-series arrangement, each node is connected only to a first and a second umbilical line section, and no other umbilical sections. For example, node $\mathbf{133}_1$ is connected to the first line section $\mathbf{120}_1$ is connected at the junction at the fore end, and the second line $\mathbf{120}_2$ extends from the reel and exits through one of the aft end or one of the first or second side portions. Similarly, node $\mathbf{133}_2$ is connected to the second line section $\mathbf{120}_2$ is connected at the junction at the fore end, and a line extends from the reel and exits through one of the aft end or one of the first or second side portions.

Figure 1B:
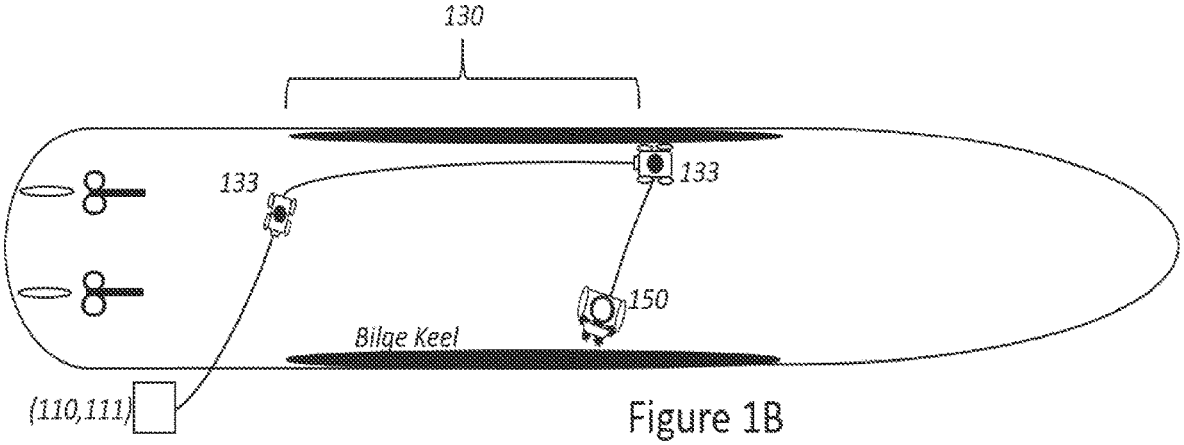
FIG. 1B is an exemplary underside hull view of the hull maintenance system having an in-line multi-node tether management system, according to an embodiment of the invention.
Figure 1C:
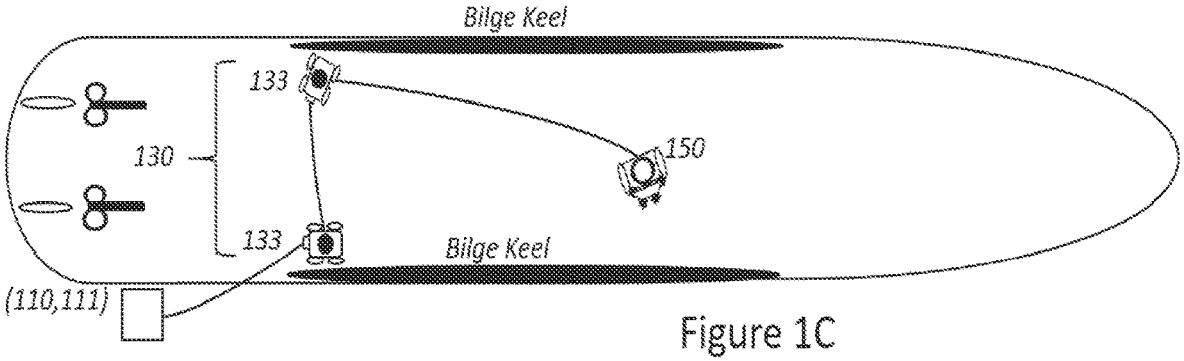
FIG. 1C is an exemplary underside hull view of the hull maintenance system having an in-line multi-node tether management system, according to an embodiment of the invention.

Returning to FIG. 1A, the hull maintenance system is shown from a side view. FIGS. 1B and 1C are underside hull views of the hull maintenance system having in-line multi-node tether management systems 130, according to embodiments of the invention. Both FIGS. 1B and 1C show two nodes 133 and an end effector vehicle 150 connected by umbilical line sections 120, the line sections transmitting power from the power source (not shown). In the illustrations of FIGS. 1B and 1C, the nodes 133 and the end effector vehicle 150 are operating underwater. FIG. 1B shows the two nodes in a fore and aft arrangement, whereas FIG. 1C shows the two nodes in an athwart-ship arrangement. As illustrated, the different arrangements as shown in FIGS. 1B and 1C, allows the end effector vehicle 150 to operate in different regions.

According to the invention, the nodes 133 are vehicles that are driven to a desired position at which they are parked, secured, or affixed, during a specific maintenance routine, after which they could be repositioned for another maintenance routine. The positioning of the nodes 133 may be performed autonomously, manually (for example, using remote controllers), or a combination thereof. A specific maintenance routine may be for example, cleaning a particular region on the hull 101, such as the starboard bow region. FIG. 1B shows the two nodes 133 in a fore and aft arrangement, and the end effector 150 performing a maintenance routine at a port side bilge keel portion of the hull. FIG. 1C shows the two nodes 133 in an athwart-ship arrangement, and the end effector 150 performing a maintenance routine at a fore portion of the hull. The semi-fixed vehicle nodes 133 reduce the entanglement hazard by controlling slack in the umbilical line 120 along the hull 101.

Figure 1D:
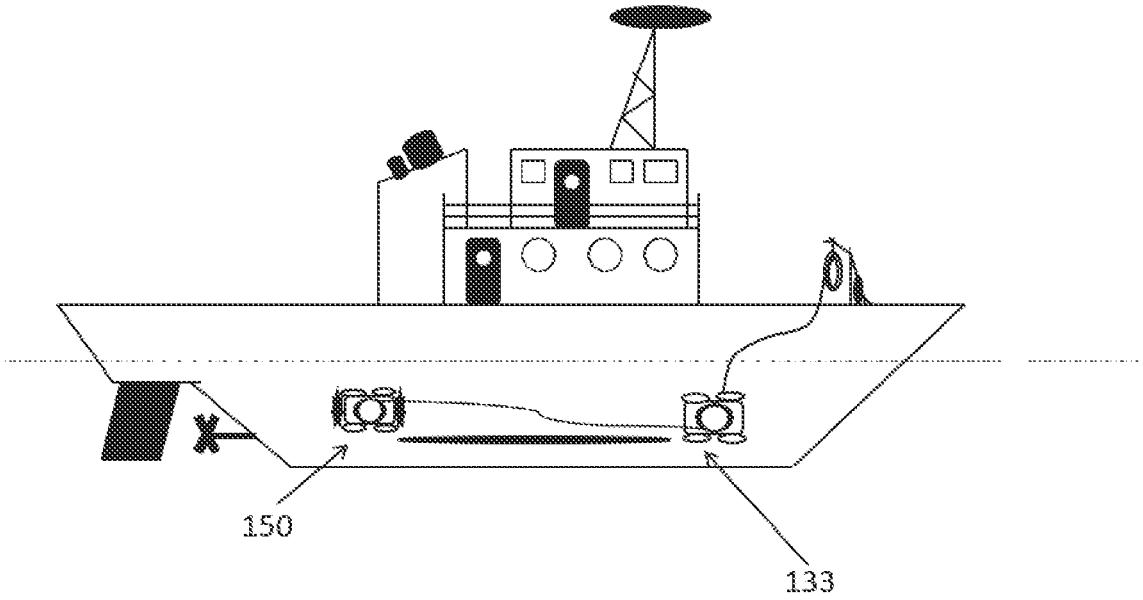
FIG. 1D is an exemplary illustration of an in-line tether management systems having a single node and an end effector vehicle, according to an embodiment of the invention.
Figure 1E:
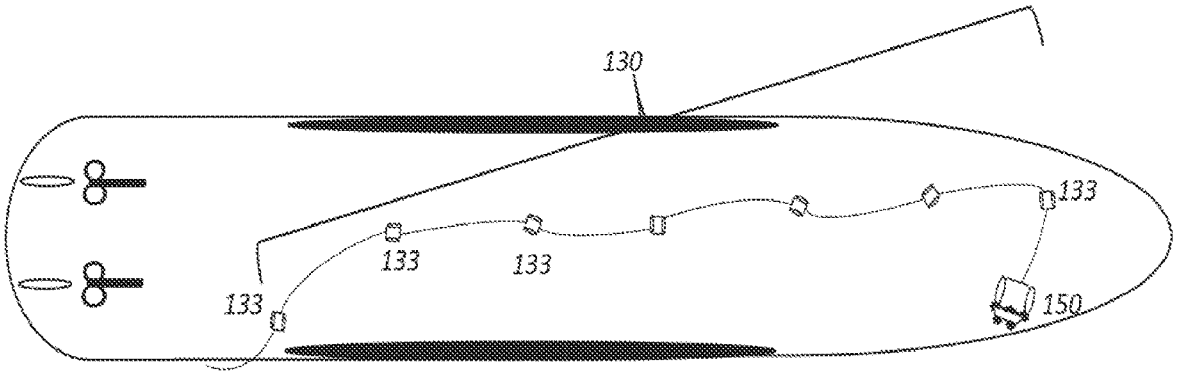
FIG. 1E is an exemplary illustration of an in-line tether management systems having seven nodes and an end effector vehicle, according to an embodiment of the invention.
Figure 1F:
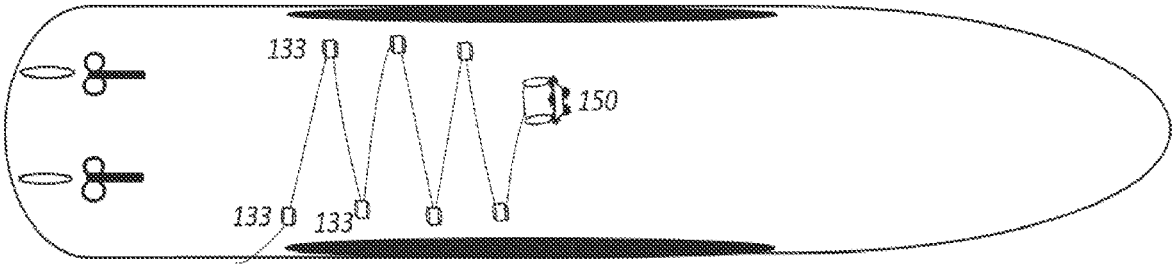
FIG. 1F is an exemplary illustration of an in-line tether management systems having seven nodes and an end effector vehicle, according to an embodiment of the invention.

Although the embodiments of FIGS. 1A-1C have two nodes 133, according to the invention, and as outlined below, there may as many nodes as desired. The number of nodes 133 may depend on, among other things, the length or size of the water vessel hull 101, the location of the supply reel 110 in relation to the location of the hull being serviced, or the type of servicing to be performed. Therefore in-line tether management systems may have a single node (as shown in FIG. 1D), or may have two, three, four, or even more nodes 133. FIGS. 1E and 1F illustrate in-line tether management systems 130 having seven nodes 133 and an end effector vehicle 150.

As outlined below, the tether management systems 130 according to the invention, intrinsically assist with the navigation of an end effector vehicle 150, by providing approximate distances and geometric reference between vehicle nodes 133. Arrangements having at least two nodes as shown in FIGS. 1A-1C and IE-IF provides more accurate and more efficient tracking of the end effector vehicle, as compared to the single-node arrangement of FIG. 1D, because the sensors in multi-node arrangements have of the ability to triangulate signals from two nodes 133 and the end effector 150. However, circumstances may dictate that only a single node is used in the arrangement as shown in FIG. 1D, and in that embodiment, the system is able to track the end effector vehicle 150 with reasonable accuracy.

Figure 3A:
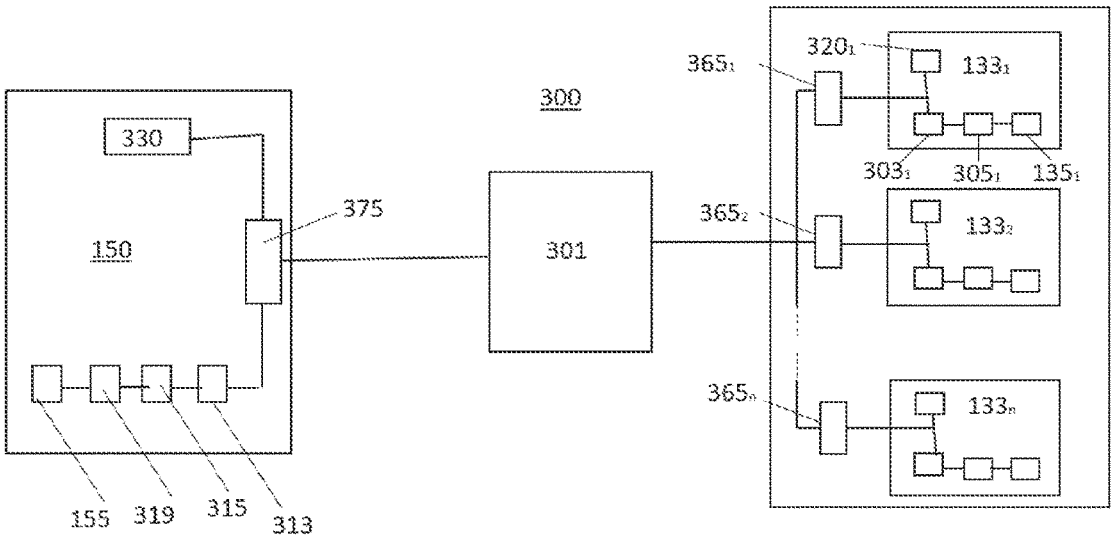
FIG. 3A is an exemplary illustration of a control system for controlling the operations of the hull maintenance system, according to an embodiment of the invention.

FIG. 3A is an exemplary illustration of a control system 300 for controlling the operations of the hull maintenance system. This includes controlling surface grooming functions, surface surveying functions, and functions related to these operations, such as for example, monitoring the locations of the one or more nodes 133 and the end effector vehicle 150, monitoring and adjusting tensions in the umbilical line sections 120, and monitoring and controlling grooming/cleaning functions of the end effector vehicle 150.

The control system 300 includes a system controller 301 electronically connected to nodes (133$_1$, 133$_2$ . . . 133*n*), wherein the total number of nodes depends on the particular arrangement. (See FIG. 2B.) For example, in the arrangement of FIG. 1C there are two nodes 133 in FIG. 1D it is one node 133, and in FIG. 1E there are seven nodes 133. FIG. 3A also shows the system controller 301 electronically connected to the end effector vehicle 150.

The electronics of the system controller 301 may include hardware or software that includes firmware, resident software, micro-code or the like. The controller 301 electronics may include a combination of hardware and software. The functions of the controller 301 may be defined in a computer program which, partitions the hull surface into different segments, and defines and controls maintenance routines according to the particular segment, as well as the sequencing of the maintenance routines, within each segment, and from one segment to another.

These maintenance routines generally involve cleaning/grooming and surveying hull surfaces, generally below the waterline. The computer program may be on a platform such as a computer readable storage medium (or media) having computer readable program instructions. The computer readable storage medium may be a tangible device that can retain and store instructions for use by an instruction execution device.

The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch cards or raised structures in a groove having instructions recorded thereon, and any suitable combination of the foregoing.

As shown in FIG. 3A, the system controller 301 is electronically connected to each node's steering mechanism 303 for steering the node, driving mechanism 305 for driving/moving the node about the hull surface, and reel mechanism for reeling-in and reeling-out the umbilical sections. As shown, the controller 301 may be connected to a sub-controller 365 on the node, and thereby control the steering mechanism 303, the driving mechanism 305, and the reel mechanism, via the sub-controller 365. According to an embodiment of the invention, the sub-controller 365 could be integrated within the controller 301.

FIG. 3A also shows the system controller 301 electronically connected to the end effector vehicle's steering mechanism 313 for steering the end effector vehicle, the driving mechanism 315 for driving the end effector vehicle about the hull surface at controlled speeds that facilitate proper cleaning/grooming and surface surveying functions, and also prevents entanglement of the umbilical sections. FIG. 3A schematically shows the controller 301 electronically connected to the reel mechanism 155 for reeling-in and reeling-out the umbilical sections. FIG. 3A also shows the controller 301 also electronically connected to the grooming/cleaning mechanisms 319, which may be cleaning brushes, water jets, UV devices, or other known cleaning/grooming devices. As shown, the controller 301 may be connected to a sub-controller 375 on the end effector 150, and thereby control the steering mechanism 313, the driving mechanism 315, the reel mechanism 155, and the grooming/cleaning mechanism 319, via the sub-controller 375. According to an embodiment of the invention, the sub-controller 375 could be integrated within the controller 301.

Both sub-controllers 365 and 375 may include hardware or software that includes firmware, resident software, micro-code or the like. The controller electronics of sub-controllers 365 and 375 may include a combination of hardware and software. The functions of the sub-controller 365 and 375 may be defined in a computer program, which may be on a platform such as a computer readable storage medium (or media) having computer readable program instructions. The computer readable storage medium may be a tangible device that can retain and store instructions for use by an instruction execution device. The sub-controllers 365 and 375 may include all the features and characteristics outlined above with respect to controller 301.

Figure 3B:
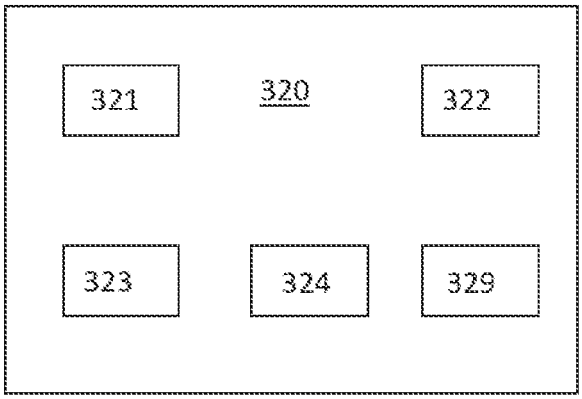
FIG. 3B is an exemplary illustration of a sensor suite for each vehicle node, according to an embodiment of the invention.
Figure 3C:
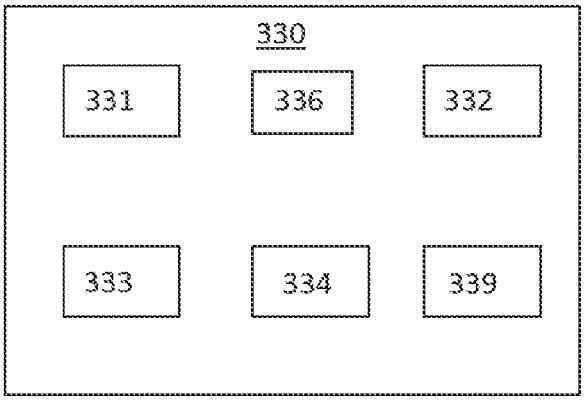
FIG. 3C is an exemplary illustration of a sensor suite for the end effector vehicle, according to an embodiment of the invention.

As illustrated, the controller 301 is electronically connected to sensor suites 320 and 330. Each vehicle node 133 has a sensor suite 320 and the end effector 150 has a sensor suite 330 located thereon. The sensor suites 320 and 330 may include known sensors that operate effectively in underwater environments. The sensor suites 320 on the nodes 133 include sensors for locating their position as well as the position of the end effector vehicle 150. These node sensors work in concert with sensor suite 330 located on the end effector 150. The sensor suites 320 may include one or more sonar or doppler transmitters and/or receivers or transponders, communicating with one or more sonar or doppler transmitters and/or receivers or transponders in the sensor suite 330 of the end effector 150. For example, in an embodiment in which there are sonar transponders in the sensor suite 320 on the one or more nodes 133, and sonar transponders in the sensor suite 330 of the end effector 150, the signals from the one or more nodes 133 and the end effector 150 ping off each other to provide a location of the end effector 150 with respect to the one or more vehicle nodes 133. FIGS. 3B and 3C show sensor suites 320 and 330, respectively.

As shown in FIG. 3B, according to an embodiment of the invention, the sensor suite 320 for each vehicle node 133 includes the following sensors/detectors. It should be understood that each numbered sensor outlined below and illustrated schematically in FIG. 3B, may be a known multiple-element arrangement that provides the desired sensing system. As shown, sensor suite 320 includes a tension sensor arrangement 321, which is associated with the reel and umbilical line section 120 to detect the tension in the line section 120. Additionally, the suite 320 may include sensor 329 that monitors the length of umbilical line section that is paid-out. The suite also includes depth, attitude, and inertial sensor arrangement 322 for sensing how far below the water the node 133 is, and also the orientation of the node 133. The sensor 322 may include, for example, a sonic transducer that emits acoustic signals, or an arrangement having GPS technology. The sensor suite also includes sonar devices 323 which may be directional or omni-directional, which as outlined below, works in concert with a sonar device on the end effector vehicle 150 to locate the end effector 150. The sensor suite may optionally include a transponder device 324, which may be an ultra-short baseline, a short baseline, or long baseline device for locating the end effector 150.

As shown in FIG. 3C, according to an embodiment of the invention, the sensor suite 330 for the end effector vehicle 150 includes the following sensors/detectors. It should be understood that each numbered sensor outlined below and illustrated schematically in FIG. 3C, may be a known multiple-element arrangement that provides the desired sensing system. As shown, sensor suite 330 includes a tension sensor arrangement 331, which is associated with the reel 110 and umbilical line section 120 to detect the tension in the line section 120. Additionally, the suite 330 may include sensor 339 that monitors the length of umbilical line section that is paid-out, by for example, monitoring the rotation of the reel. The suite also includes depth, attitude, and inertial sensor arrangement 332 for sensing how far below the water the vehicle 150 is, and also the orientation of the node 150 as it travels along the outer surface of the hull. The sensor suite 330 also includes sonar devices 333 which may be directional or omni-directional, which as outlined below, may work with the sonar devices 323 on the nodes 133 to locate the end effector 150. The sensor suite 330 may optionally include a transponder device 334, which may be an ultra-short baseline, a short baseline, or long baseline device for locating the end effector 150.

Additionally, the sensor suite 330 may include odometry devices associated with wheels or tracks of the vehicle 150 to measure distances and to locate the position of the vehicle 150. Because the end effector 150 provides cleaning/grooming functions, the sensor suite 330 also include grooming sensor sub-suite 336 related to the monitoring and performance of these functions. Therefore the sub-suite 336 may include known video-related detectors to monitor the hull surface and coatings thereon, fouling, or the detection of foreign objects. The sensors 336 may also include detectors associated specifically with the cleaning/grooming elements, such as brush sensors, UV sensors, water-jet sensors, and the like.

In operation, the system controller 301 communicates with node sub-controller 365 and the vehicle sub-controller 375 to operate system requirements. For example, the system controller 301 may communicate operation information to the vehicle controller 375 based on information it receives from the sensor suites 320 and 330. Therefore, for example, based on sonar information from sensors 323 on nodes 133 and related sonar information from the end effector sensor 333, the location of the end effector could be determined. Additionally, based on maintenance logistics such as video information provided by the sub-suite 336, it may be determined that grooming in a selected segment of the hull is complete, and that the end effector vehicle 150 should be moved to an adjoining hull segment. Accordingly, the system controller 301 communicates with the vehicle sub-controller 375 to control the steering mechanism 313 and the driving mechanism 315 of the end effector 150, so that when it is moving to the adjoining hull segment, the end effector 150 moves at a speed that allows for safe retraction of the umbilical 120, to prevent entanglement. Additionally, the retraction or general tension in umbilical sections 120 may be controlled to prevent entanglement based on, for example location data and odometry data communicated to the controller 301. Exemplary processes for the operation and control of the hull maintenance system are outlined below.

Figure 4A:
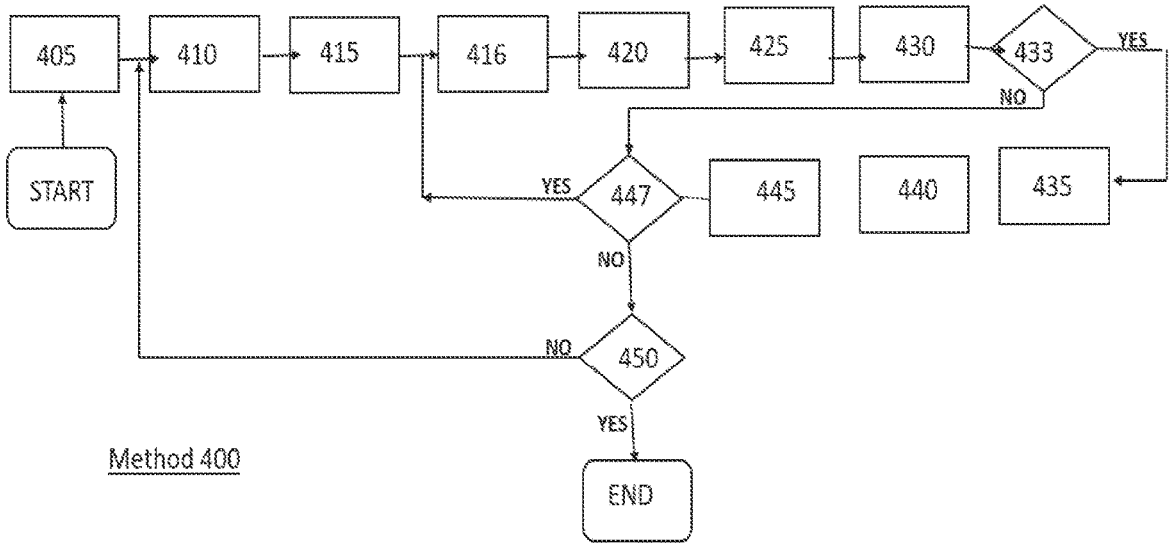
FIG. 4A is an exemplary method of using a hull maintenance system to perform maintenance on hull surfaces, according to an embodiment of the invention.

FIG. 4A is an exemplary method 400 of using a hull maintenance system to perform maintenance on hull surfaces. The hull maintenance system having hull surfaces below the waterline (underwater surfaces), an end effector for grooming/cleaning/surveying the underwater surfaces, a plurality of umbilical line sections for transmitting power, from a main power supply 111 throughout the system and for powering the end effector, a tether management system having one or more nodes in an in-line (in-series) arrangement between the main power supply at one end and the end effector at another end. The hull maintenance system also includes a control system for controlling maintenance operations.

According to an embodiment of the invention, the hull maintenance is directed toward the grooming of underwater surfaces, which also involves surveying these surfaces. It should be understood that according to another embodiment, this process could be performed solely to survey the surface of the hull without performing any grooming/cleaning functions. It should also be understood that many of the steps outlined below for the method 400 are closely related and fluid, and may overlap in terms of the when certain steps are performed.

Figure 4B:
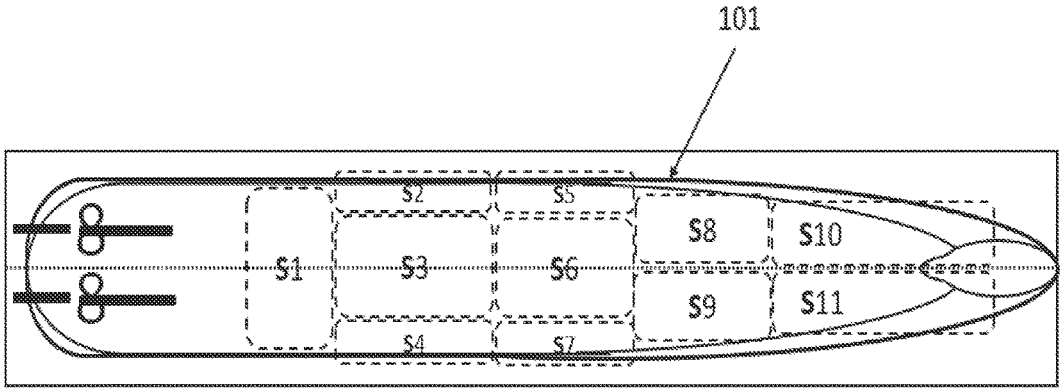
FIG. 4B is an exemplary illustration of a hull structure partitioned into different segments, according to an embodiment of the invention.

FIG. 4A shows the method having step 405, the defining of distinct work areas for a particular hull structure. According to the method, the functions of the system controller 301 are defined in a computer program. Based on known hull types or similarity with known hull types, the computer program partitions or segregates the hull surface into different segments, defining different work areas. FIG. 4B is an exemplary illustration of a hull structure 101 partitioned into different segments by the computer program, according to the invention. FIG. 4B shows the hull 101 partitioned into eleven segments, S1-S11. Alternatively, a user may manually enter the segments into the computer program. The segments, once determined, all have different known topographies, and the computer program defines a cleaning routine for each particular segment. The program may also determine how many of the defined segments are to undergo maintenance. Therefore for example, the program may require one, two, three, etc., or all of the segments are to undergo maintenance. The number of segments to undergo a maintenance routine may also be determined by user-input.

Step 410 is the selection of a particular segment to begin hull maintenance, which may be grooming/cleaning or surveying. The selection of this particular segment/work area may be inputted by a user or may be automatically performed by the computer program. For example, a user may select segment 6 (shown in FIG. 4B) near the middle of the hull because there may be a need to clean that particular area. The program may automatically select segments to clean, starting from the bow and moving toward the stern of the hull. Based on the selected segment, the computer program defines and controls a grooming routine suitable for that area and topography. The segment may be further divided into two cleaning halves, the first half of the segment a "heads-up" area and the second half, a "reciprocal". The sequencing of maintenance from one segment to another may also be performed manually by a user, or automatically by the computer program.

Step 415 is the positioning of the one or more vehicle nodes 133 of the tether management system 130 on the hull surface within the selected segment. Step 416 is the positioning of the end effector vehicle 150 on the hull surface, which is typically underwater. Although step 416 is performed after step 415, these steps are closely related, so they are outlined together in this section of the disclosure. According to the process, the one or more nodes may be manually positioned by a user, remotely controlled, or autonomously positioned to enable the end effector 150 to function properly and efficiently, i.e., perform the desired grooming and surveying in the selected work area/segment. If for example, the selected work area extends from the bow to a point about 300 ft. from the bow, then the one or more nodes may be placed at about 150 ft. from the bow, and the end effector vehicle 150 is placed in an initial working position somewhere between the bow and the one or more nodes 133. If the selected work area extends 150 ft. from the bow, then the one or more nodes 133 are placed at about 75 ft. from the bow, and the end effector is placed in an initial working position somewhere between the bow and the one or more nodes 133.

As stated above, the selected segment for grooming may be divided into two halves, the first half of the segment a "heads-up" area and the second half, a "reciprocal". According to the method, the reciprocal area may be a mirror image of the heads-up area. Thus, for each selected segment, the maintenance is first performed in the heads-up area, followed by maintenance in the reciprocal area. According to the process, the one or more vehicle nodes 133 are positioned in an area that borders both the "heads-up" area and the "reciprocal" area so that no repositioning or minimal repositioning of the one or more nodes is necessary to for moving the end effector vehicle 150 from one area to the other, to perform maintenance.

In autonomous embodiments, the positioning of the vehicle nodes 133 may be controlled by system controller 301 and node sub-controllers 365. The end effector vehicle 150 may be manually placed in an initial working position on the hull within the segment, or alternatively may be positioned by the controller 301 and vehicle sub-controller 375. According to an embodiment of the invention, the sub-controller 375 could be integrated within the controller 301. As outlined below, the one or more nodes will track the end effector 150 and also maintain a desired tether tension in the umbilical line 150, preventing entanglement of the umbilical line sections 120.

Regarding the positioning of the one or more vehicle nodes 133 of the tether management system 130, in step 415, the nodes may be positioned in any of the arrangements shown in FIGS. 1A-1F, and as outlined above. Therefore the one or more nodes 133 may be the two nodes, as positioned in the arrangement of FIG. 1B. Alternatively, the one or more nodes 133 may be the seven nodes, as positioned in the arrangements of FIGS. 1E and 1F.

Step 420 is the initializing of the system sensors. The controller 301 initializes the sensors of sensor suite 320 associated with the vehicle nodes 133 and sensor suite 330 associated with the end effector vehicle 150, with many of the sensors in sensor suites 320 and 330 working in concert with each other. Thus, the controller 301 initializes the host of sensors in suites 320 and 330, including the tension sensors (321, 331) and sensors (329, 339) that monitor the length of the umbilical sections that are paid-out.

The controller 301 also initializes depth, attitude, and inertial sensor arrangements (322, 332). In embodiments that include sonar devices for tracking the location of the end effector 150, the sonar sensors (323, 333) are initialized. In embodiments that include transponders for locating the end effector 150, these sensors (324, 334) are initialized. The initializing of the sonar sensors (323, 333) and/or transponders (324, 334) is accomplished within the first few feet (3 ft. to 6 ft.) of travel by the end effector 150. The controller 301 also initializes the odometry device and grooming sensor sub-suite 336 on the end effector vehicle 150, which may include sensors associated with grooming, such as video sensors, brush sensors, UV sensors, water-jet sensors, and the like. At this stage the tether slack and range is preset based on the known work area and the grooming routine, and based on data from the odometry device and data from sonar sensors (323, 333) and/or transponders (324, 334). This preset and data is used to control the umbilical spooling in the nodes and end effector. The tether slack and range is preset to prevent any entanglement of the umbilical line sections.

Step 425 is the initiation and performance of the end effector maintenance routine within the selected work area/segment. This routine is tailored for the topography of the work area being groomed. According to the process, the end effector maintenance routine may first perform in the "head-up" area. The system controller 301 initiates this process, which is executed by the computer program. The end effector maintenance routine involves grooming the underwater hull surface. The system controller 301 via sub-controller 375 initiates the maintenance tools, cleaning/grooming mechanisms 319, powering on the cleaning brushes, water jets, and other grooming devices to groom the hull surface in the computer-defined work-area of the particular segment. The end effector vehicle 150 drives the programmed path for the work-area utilizing data streams from the inertial sensor 332 and the odometer. The vehicle sub-controller 375 (which may be integrated within the system controller 301) may perform steering and driving functions. Sonars 333 and/or transponder 334 tracking further verifies positioning and mission coverage of the end effector vehicle 150.

The end effector vehicle 150 also surveys the underwater surface utilizing video and/or UV sensors in the grooming sensor sub-suite 336, to ensure that grooming functions are performed successfully, and also acquires nearby hull features or fiducials when travelling at the bordering areas of the work area, to facilitate re-starts and repositioning for next work area.

Step 430 is the utilizing of the tether management system (having the one or more nodes 133) to track the location of the end effector vehicle 150 and to maintain a desired tether tension in the umbilical line 120 to prevent entanglement of the line section 120 attached to the end effector. It should be understood that step 430 occurs during step 425, the initiation and performance of the end effector maintenance routine. The one or more nodes 133 track the end effector 150 during its travel from a "near" end of the work-area to a "distant" end of work-area as the end effector executes the grooming of the hull surface.

The tracking is performed by sonar sensors 323 and/or transponders 324 on the nodes, which communicate with like sensors (333, 334) on the end effector 150. For example, in the arrangement of FIGS. 1B and 1C, because of the presence of two nodes 133, and the end effector 150, sonar signals triangulate between two nodes 133 the end effector 150, to accurately locate the end effector 150. Similarly, if transponders 324 are employed, the triangulation of signals between the node transponders 324 and end effector transponder 334, provide the location of the end effector 150. In systems with more than two nodes, as those illustrated in FIGS. 1E and 1F, all of the nodes 133 may be used to track the end effector 150. In a system as illustrated in FIG. 1D with a single-node 133, the signals ping between the single node 133 and the end effector 150 to provide the end effector location, although the location process is not as accurate as with systems having multiple nodes 133. The odometry sensor may also provide supplemental data to track the whereabouts of the end effector 150.

Consequently, during step 430, as the movement of the end effector vehicle 150 is tracked by the nodes 133 and odometry, as described above, adjustments are made to keep/maintain the umbilical line section 120 at a desired tension and length as it extends from the end effector. Thus, according to the tracked path of the end effector, the controller 301, via sub-controller 375, rotates the respective reel or reels to pay-out or pay-in umbilical section 120 to the appropriate length and tension to avoid entanglement. For example, if the programmed mission/grooming path involves the end effector 150 moving further away, the sub-controller 375 would control the reel 155 to pay out the umbilical section 120. If the programmed path involves movement back toward a starting position, the sub-controller 375 would control the reel to pay-in the umbilical section 120. Other umbilical line sections 120, not directly connected to the end effector vehicle 150, should not be in need of adjustment because during this phase, the nodes 133 are stationary, and thus the adjustments made in the initialization step 425 should suffice.

Step 433 is a decision-making step, determining if small-scale localized indexed repositioning of the one or more nodes 133 is necessary to facilitate further surveying and/or grooming of the work-area that is being groomed. The determination may be based on hull features or fiducials gathered by the end effector's video and other sensors when travelling the programmed path. Alternatively, the computer program may also include an override function that allows for the program to make a decision based on whether the small-scale localized indexed repositioning of the nodes 133 was previously performed. Alternatively, a user may manually enter a decision as to whether to perform the repositioning.

If the decision is "NO", then the process skips ahead to step 447, outlined below. If the decision is "YES" then the small-scale localized repositioning of the nodes 133 is performed in Step 435. Because this repositioning of each node is minimal, maybe about 1 to 2 yards, re-initializing of the system sensors is not necessary. Also, it is not expected that there would be significant changes in the tension of the umbilical sections between one node to another, or between the main power source 111 and the first node 133, so adjustments for in umbilical section lengths and tensions may not be necessary. However, if tension adjustments are necessary, the umbilical section tensions may be adjusted at this point. Step 435 is followed step 440, which is the performance of the end effector maintenance routine in that localized area.

Step 445 is the utilizing of the tether management system (having the one or more nodes 133) to track the location of the end effector vehicle 150 and to maintain a desired tether tension in the umbilical line 120 to prevent entanglement of the line section 120 that is attached to the end effector vehicle 150. The process of step 445 is similar to step 430 outlined above. In step 445, the one or more nodes 133 track the end effector 150 during its travel in the localized area.

Step 447 is a decision-making step. At step 447 it determined if maintenance of the reciprocal area is required. Maintenance of the reciprocal area may be required if for the purposes of maintenance, the selected segment of step 410 was divided into two parts, a heads-up area and a reciprocal area, and if maintenance had only been performed on the heads-up area. If maintenance had been performed on the entire segment, whether or not it was broken up into two parts, then at this stage, there would be no requirement for the end effector vehicle 150 to work on the reciprocal area. If the decision is "YES" and maintenance of the reciprocal area is required, then the process goes back to step 416, which is the positioning of the end effector vehicle 150 in the work area. If the decision is "No" and maintenance of the reciprocal area is not required, then the process moves to decision step 450.

At step 450, it is determined whether or not maintenance has been performed in all desired segments. As stated above, the controller run computer program may determine how many of the defined segments are to be maintained. Therefore for example, the program may require one, two, three, etc., or all of the segments are to be maintained. The number of segments to undergo a maintenance routine may also be determined by user-input. At step 450, if "YES" another segment is to undergo a maintenance routine, then the process goes to step 410, the selection of the particular segment to undergo maintenance. At step 450, if "NO" no another segment is to undergo a maintenance routine, then as shown in FIG. 4A, the process ends.

What has been described and illustrated herein are preferred embodiments of the invention along with some variations. The terms, descriptions and figures used herein are set forth by way of illustration only and are not meant as limitations. For example, the system may be employed to survey or maintain underwater vessels or structures that are not ships. The system may also be employed for non-hull surfaces, and may be used to clean the walls of a water-enclosure structure, like submerged walls of pools or ship-testing facilities. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A method of maintaining the outer surface of a hull, comprising:

providing a power source, and on the outer surface of the hull, providing:

one or more node vehicles each node having a node sensor suite;

an end effector vehicle to perform maintenance routines, the end effector having hull maintenance tools and a sensor suite, a plurality of umbilical line sections for providing power to the one or more node vehicles and the end effector vehicle, wherein the umbilical sections extend in an in-line arrangement connecting the one or more node vehicles and the end effector vehicle to the power source, the method further comprising:

partitioning the outer surface of the hull into different segments that define work areas;

selecting one of the defined work areas to begin hull maintenance;

positioning of the one or more node vehicles onto the hull surface within the selected defined work area;

positioning of the end effector vehicle onto the hull surface within the selected defined work area;

initializing system sensor suites of the one or more node vehicles and the end effector;

initiating the end effector vehicle to perform a maintenance routine within the selected work area; and utilizing the sensor suites to track the location of the end effector vehicle to maintain a desired tether tension in the umbilical line sections to prevent entanglement of the umbilical line sections.

2. The method of maintaining the outer surface of a hull of claim 1, further comprising:

determining if small-scale localized repositioning of the one or more nodes is required to facilitate additional maintenance work, and wherein if small-scale localized repositioning is required the method further comprises;

the small-scale localized repositioning of the one or more nodes, performing an end effector maintenance routine within the localized area, utilizing the sensor suites to track the location of the end effector vehicle to maintain a desired tether tension in the umbilical line sections to prevent entanglement of the umbilical line sections.

3. The method of maintaining the outer surface of a hull of claim 2, wherein in the selecting one of the defined work areas to begin hull maintenance, the defined work area is further defined into two areas, a heads-up area and a reciprocal, and wherein the end effector first performs the maintenance routine in the heads-up area followed by a maintenance routine in the reciprocal area.

* * * * *